US006648678B1

(12) United States Patent
Kaneko

(10) Patent No.: US 6,648,678 B1
(45) Date of Patent: Nov. 18, 2003

(54) STRUCTURE OF ROTATABLY MOUNTING AN ELECTRONIC UNIT ON AN ELECTRICAL CONNECTION BOX IN A REMOVABLE MANNER

(75) Inventor: Keiichiro Kaneko, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/635,406

(22) Filed: Aug. 10, 2000

(30) Foreign Application Priority Data

Aug. 10, 1999 (JP) ..... 11-226504

(51) Int. Cl.[7] ..... H01R 13/60

(52) U.S. Cl. ..... 439/536; 439/34; 439/157; 439/352; 439/596

(58) Field of Search ..... 439/536, 34, 157, 439/160, 165, 596, 341, 350, 352, 357, 358

(56) References Cited

U.S. PATENT DOCUMENTS

| | | | | |
|---|---|---|---|---|
| 4,972,296 A | | 11/1990 | Chu | |
| 5,308,261 A | * | 5/1994 | Kightlinger | 439/358 |
| 5,639,253 A | | 6/1997 | Rantanen | |
| 6,133,531 A | * | 10/2000 | Hayduke et al. | 174/67 |

FOREIGN PATENT DOCUMENTS

| | | | |
|---|---|---|---|
| JP | 4-137427 | 12/1992 | H02G/3/16 |
| JP | 7-135720 | 5/1995 | H02G/3/16 |
| JP | 9-149527 | 6/1997 | H02G/3/16 |
| JP | 10-41008 | 2/1998 | H01R/13/639 |
| WO | WO 98 56450 A | 12/1998 | |

* cited by examiner

*Primary Examiner*—P. Austin Bradley
*Assistant Examiner*—Truc Nguyen
(74) *Attorney, Agent, or Firm*—Sughrue Mion, PLLC

(57) ABSTRACT

Female and male terminals are provided on body casings of opposite ones of an electric connection box and an electronic unit so as to be electrically connected when combined together. The electric connection box and the electronic unit are connected together through hinge means, provided respectively on the two body casings, so as to be pivotally moved relative to each other in a combining direction, the two hinge means being formed by a pivot grooves and a pivot rods, respectively. The two hinge means, formed respectively by the pivot grooves and the pivot rod, can be engaged with and disengaged from each other with a one-touch operation. With this construction, any deflection will not occur in a positioning operation when combining the electronic unit with the electric connection box and therefore the male terminals can be positively fittingly connected to the female terminals, respectively, thus avoiding a half-fitted condition.

20 Claims, 5 Drawing Sheets

STRUCTURE OF ROTATABLY MOUNTING AN ELECTRONIC UNIT ON AN ELECTRICAL CONNECTION BOX IN A REMOVABLE MANNER

BACKGROUND OF THE INVENTION

1. Technical Field

This invention relates to a mounting structure in which an electronic unit can be easily connected to an electric connection box, such as a junction box, so as to make an electrical connection.

2. Related Art

Automobiles have been equipped with electronic devices, and therefore a wide variety of electronic parts to be mounted on the automobiles have been developed. Wire harnesses, cables and wire harness have been increasingly used. Recently, in order to avoid the complexity, there have been extensively used structures in which an electronic unit is mechanically connected to an electronic connection box incorporating as many wire harnesses as possible, and the electronic unit and an electronic connection box are electrically connected such that male terminals and female terminals, provided in the electric connection box and the electronic unit respectively, are electrically connected together.

In order to properly connect all of the male terminals respectively to the female terminals, it is necessary to properly combine the electronic unit with the electric connection box by mechanical connection. The Applicant of the present application has so far proposed such structures of effectively connecting an electronic unit to an electric connection box. For examples, Japanese patent Publication Hei.7-135720A and Hei.9-149527A disclose a structure in which an electronic unit is moved toward an electric connection box in a parallel manner from the upper side or the lateral side, and is combined with the electronic connection box. Japanese Utility Publication Hei.4-137427 discloses a structure in which an electric connection box and an electronic unit are pivotally or hingedly connected together at their one ends by a pivot pin, and the electronic unit is pivotally moved to be combined with the electric connection box.

However, the above electronic unit-mounting structures, proposed by the Applicant of the present application, have the following problems to be improved.

In the former structure in which the electronic unit is moved toward the electric connection box in a parallel manner to be combined with the electric connection box, a considerable fitting force is required for positively connecting the male terminals respectively to the female terminals in the combining operation in the case where the number of the male and female terminals, provided respectively in the electric connection box and the electronic unit, is large. And besides, the electronic unit is liable to be deflected during the time when it is moved toward the electric connection box so as to be positioned relative thereto in the combining operation. Therefore it is quite possible that some pairs of male and female terminals are connected in a half-fitted condition, that is, an incompletely-connected condition.

In the latter structure in which the electric connection box and the electronic unit are hingedly connected together, the positioning of the two relative to each other is improved as compared with the former structure in which the electronic unit, separate from the electric connection box, is moved toward it in a parallel manner. However, the electric connection box and the electronic unit are almost integrally connected together at the hinge connection portions, and therefore additional time and labor are required effecting the hinge connection. And besides, after the hinge connection is effected, the product is bulky in volume, and therefore there are encountered reverse effects such as the cumbersome stock control and the lowered transportability.

SUMMARY OF THE INVENTION

It is therefore an object of this invention to provide a structure of mounting an electronic unit on an electric connection box, in which even when there are a number of male and female terminals to be connected together, all of the male terminals can be properly connected respectively to the female terminals with a small fitting force, thus avoiding a so-called half-fitted condition (incompletely-connected condition), and besides excellent assembling and disassembling abilities are achieved.

According to the present invention, there is provided A mounting structure including: an electronic unit including a first hinge portion and a unit body provided with one of at least one female terminal and at least one male terminal; and an electric connection box combinable with the electronic unit in a combing direction, the electric connection body including a second hinge portion and a box body provided with the other of the at least one female terminal and the at least one male terminal; wherein the at least one female terminal is electrically connected with the at least one male terminal, respectively, when the electronic unit is combined with the electric connection box, wherein the electronic unit and the electric connection box are connected together through the first hinge portion and the second hinge portion and are pivotally movable relative to each other in the combing direction, the first hinge portion and the second hinge portion can be engaged with and disengaged from each other with a one-touch operation.

In this construction, the body casings of the electric connection box and the electronic unit are pivotally connected together by the hinge mechanism releasably engaged with each other in a one-touch operation, and therefore any deflection will not occur in a positioning operation during the combining operation, and therefore all of the male terminals can be positively connected to the female terminals, respectively, thus avoiding a so-called half-fitted condition.

In the structure of mounting the electronic unit on the electric connection box, provided in accordance with the invention, one of the hinge mechanism is a pivot rod whereas the other hinge means is a partly-notched, U-shaped pivot recess in which the pivot rod is releasably engageable.

In this construction, one hinge means is the pivot rod while the other hinge means is the U-shaped pivot hole in which the pivot rod is releasably engageable, and therefore the electric connection box and the electronic unit can be easily combined together and separated from each other.

In the structure of mounting the electronic unit on the electric connection box, provided in accordance with the invention, a click engagement recess is provided at one of the two body casings whereas a click engagement projection is provided at the other body casing, and can be engaged in the click engagement recess with an attaching sound indicating the complete fitting of the male terminals in the respective female terminals.

In this construction, when the electronic unit is combined with the electric connection box, the click engagement projection is engaged in the click engagement recess with a feeling of click, and it can be conformed from this that all of the male terminals have been properly fitted in the female terminals, thus avoiding a half-fitted condition.

In the structure of mounting the electronic unit on the electric connection box, provided in accordance with the invention, an assist mechanism for imparting a combination-assisting force in the combining operation is provided between the two body casings.

In this construction, the assist mechanism, comprising a spring or the like, is connected between the body casings of the electric connection box and the electronic unit, and a spring force assists in providing the fitting force when the electronic unit is pivotally moved upwardly to be combined with the electric connection box, and merely with this construction, the male terminals can be easily and properly connected to the female terminals, respectively.

DESCRIPTION OF PREFERRED EMBODIMENT

A structure of mounting an electronic unit on an electric connection box according to the invention will now be described in detail with reference to the drawings.

Figure 1:
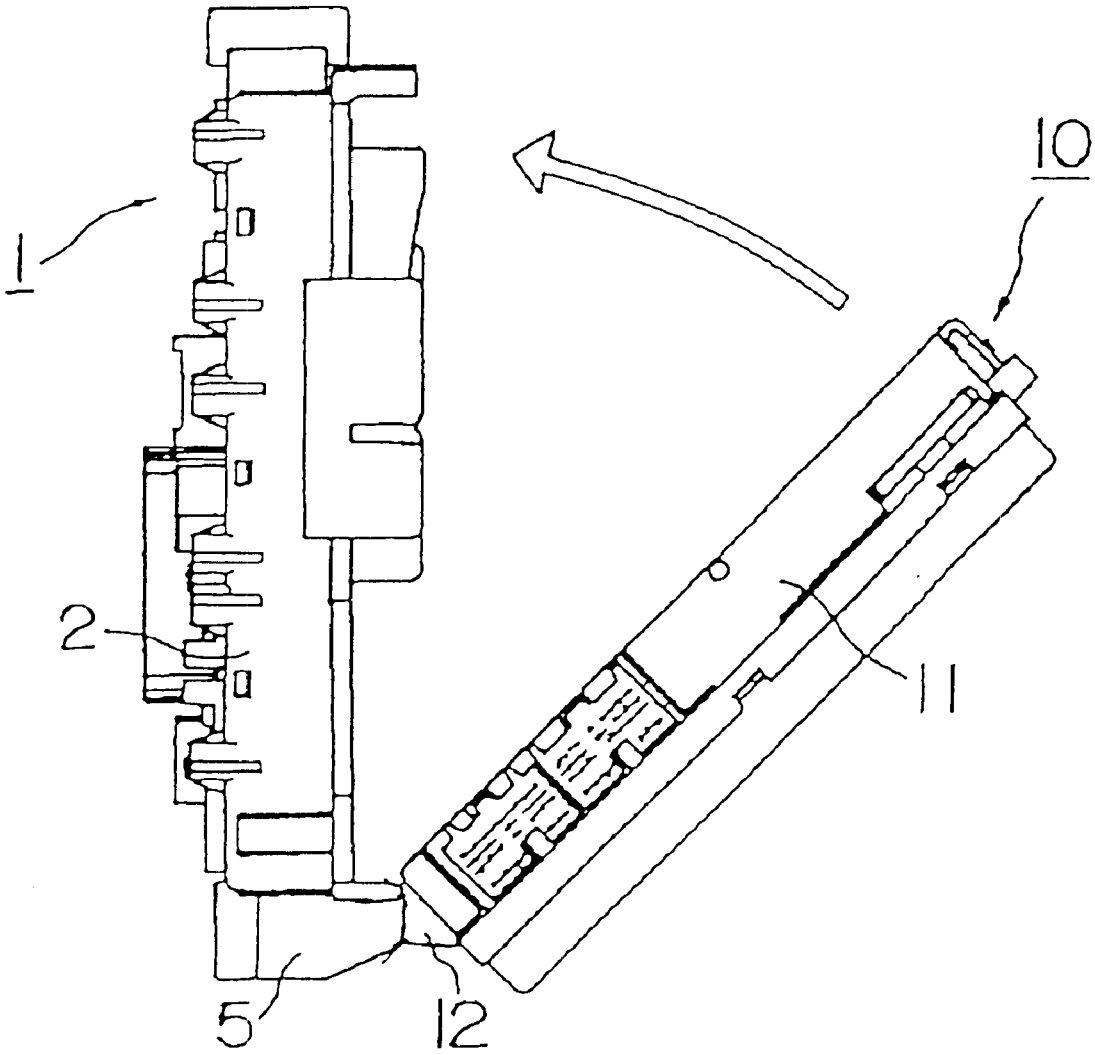
FIG. 1 is a side-elevational view showing a structure of mounting an electronic unit on an electric connection box, embodying the present invention.
Figure 2A:
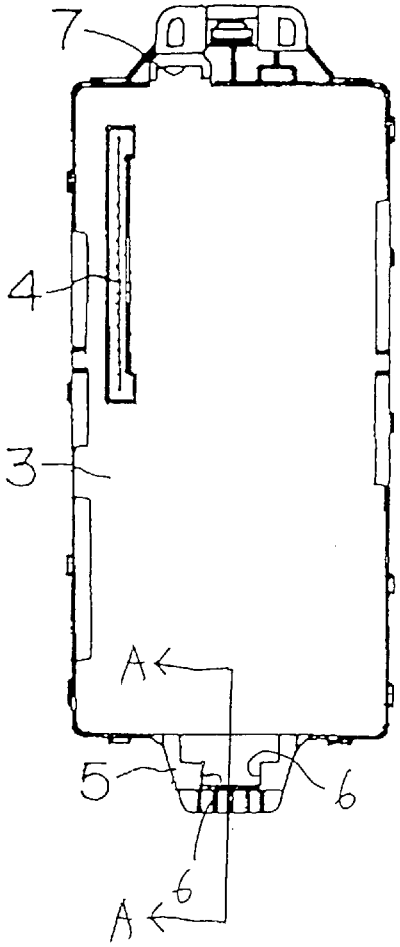
FIG. 2(A) is a rear view of a body casing of the electric connection box of the above embodiment.
Figure 2B:
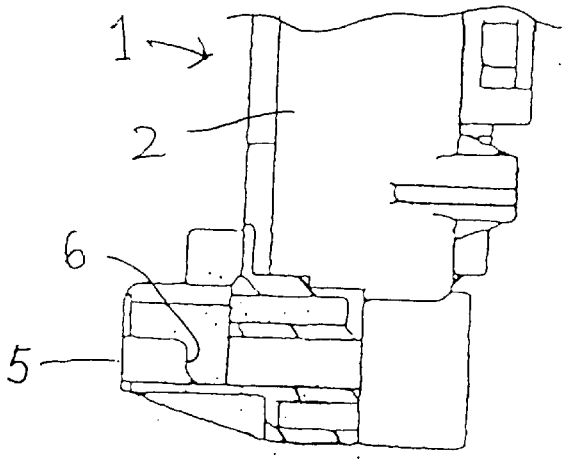
FIG. 2(B) is a partial cross-sectional view showing the structure of the cross section viewed along a ling A—A shown in FIG. 2(A).

FIG. 1 shows the structure of this embodiment. The electronic unit 10 is pivotally mounted on and removable from the electric connection box 1, such as a junction box, in a removable manner. The electronic connection box 1 includes a body casing 2. As shown in FIG. 2A, a plurality of pin terminals 4, such as male terminals, for connection respectively to terminals on the electronic unit 10 are arranged on a rear surface 3 of the body casing 2, and are exposed to the exterior of the casing 2. The rear surface 3 serves as a mating surface with which the electronic unit 10 is mated. A mounting bracket 5 is provided at one end (lower end in the drawings) of the body casing 2. The electronic unit 10 is removably mounted on this bracket 5 and is pivotally moved to be combined with the electronic connection box. As shown in FIGS. 2A and 2B, pivot grooves 6, such as a hole formed of an U-shape hook hole formed of partially notched, are formed in both sides of the mounting bracket 5.

Figure 3:
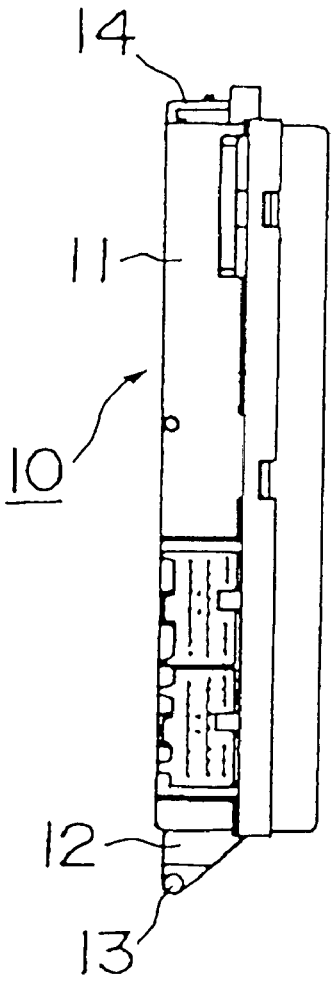
FIGS. 3(A) is a side view of the electronic unit of the above embodiment.
FIG. 3(B) is a rear view of the electronic unit of the above embodiment.
Figure 3:
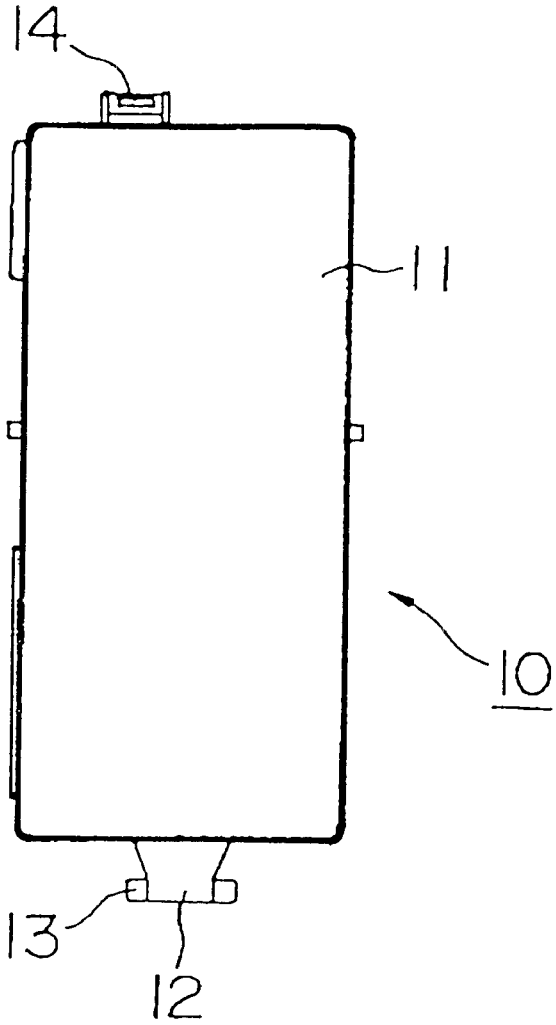

As shown in FIGS. 3A and 3B, the female terminals (not shown) are arranged on a body casing 11 of the electronic unit 10. These female terminals can be electrically connected respectively to the pin terminals 4 provided on the rear surface 3 of the body casing of the electric connection box 1. A mounting bracket 12 is provided at a lower end of the body casing 11, that is, at a position corresponding to the position of mounting of the mounting bracket 5 on the electric connection box 1. A pivot rods 13 formed in shaft shape are projected from both side of the mounting bracket 12. The pivot rods 13 can be respectively fitted in the pivot grooves 6 formed in the mounting bracket 5 of the electric connection box 1 with a one-touch operation.

Namely, the two mounting brackets 5 and 12 can be releasably connected together by simply fitting the pivot rods 13 in the pivot grooves 6 (that is, by fitting the convex and concave portions together), and with this construction the electric connection box 1 and the electronic unit 10 can be easily combined and released with each other.

A click engagement recess 7 is provided at the rear surface 3 of the body casing 2 of the electric connection box 1. A click engagement projection (convex portion) 14 is formed on the body casing 11 of the electronic unit 10 and can be engaged in the click engagement recess 7 in a one-touch manner with an attaching sound. Therefore, a feeling of attachment can be confirmed when the male terminals are completely fitted respectively in the female terminals in the combining operation.

In the above construction, the electronic unit 10 is combined with the electric connection box 1, so that the female terminals are electrically connected to the male terminals, respectively. At this time, the pivot rods 13, provided on the mounting bracket 12 on the electronic unit 10, are respectively engaged in the pivot grooves 6 in the mounting bracket 5 on the electric connection box 1 with a one-touch operation, thereby hingedly connecting the two mounting brackets 5 and 12 together.

Combining operation of the embodiment will be described with reference to FIG. 1, and FIG. 5(A) to FIG. 5(C).

Figure 5A:
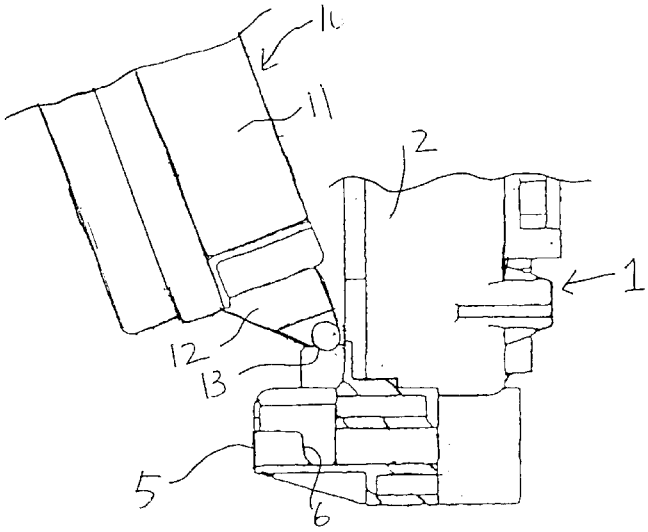
FIG. 5(A) is a cross-sectional view showing a state before the electronic unit is mounted on the electric connection box of the present invention.
Figure 5B:
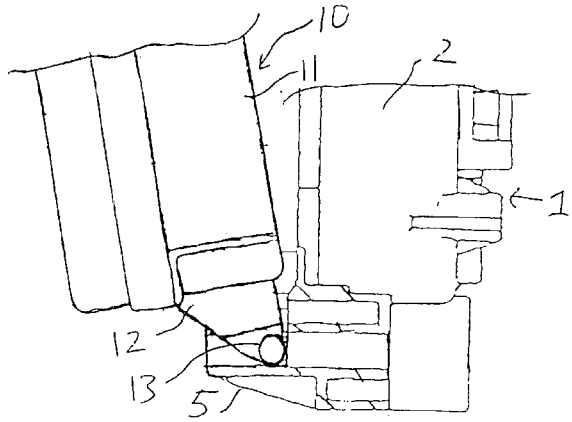
FIG. 5(B) is a cross-sectional view showing a state in which a pivot rod of the electronic unit is fitted in a pivot recess of the electric connection box.

First, as shown in FIG. 5(A) and FIG. 5(B), the pivot rods 13 of the mounting bracket 12 of the electronic unit 10 are inserted into the pivot grooves 6 of the mounting bracket 5 of the electric connection box 1, respectively.

Figure 5C:
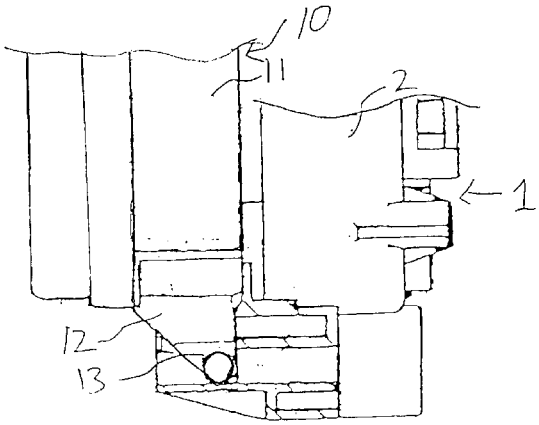
FIG. 5(C) is a cross-sectional view showing a state in which the electronic unit is combined with the electric connection box.

Then, as shown in FIG. 5(C), the electronic unit 10 is pivotally moved upwardly about the hinge connection portion including the pivot rods 13, as indicated by an arrow in FIG. 1, and is connected to the body casing 2 of the electric connection box 1 to be combined therewith. As a result, the female terminals on the electronic unit 10 are electrically connected respectively to the pin terminals 4 on the electric connection box 1.

During this combining operation, the body casings 2 and 11 of the electric connection box 1 and the electronic unit 10 do not particularly need to be positioned relative to each other. It is only necessary to pivotally move the electronic unit 10 upwardly about the pivot rods 13. At this time, the click engagement projection 14 is engaged in the click engagement recess 7 with an attaching sound. Therefore, the connection of the female terminals to the male terminals can be confirmed through this sound. Even in the case where the number of the male and female terminals (such as the pin terminals 4 on the electric connection box 1) is large, the male and female terminals can be properly connected together with a small fitting force since the pivot rods 13 on the body casing 11 of the electronic unit 10 serve as a supporting point of leverage. Therefore a half-fitted condition (electrically incompletely-connected condition) is avoided.

As the need arises, the electric connection box 1 and the electronic unit 10 in an assembled condition can be easily disconnected or separated from each other in the sequence reverse to that of the above combining operation. Thus, the electric connection box 1 and the electronic unit 10 are not always kept in integrally-connected relation to each other, but the two can be disconnected from each other when necessary. Therefore the bulky assembly can be avoided, and this is advantageous from the viewpoints of stock and transport.

Figure 4:
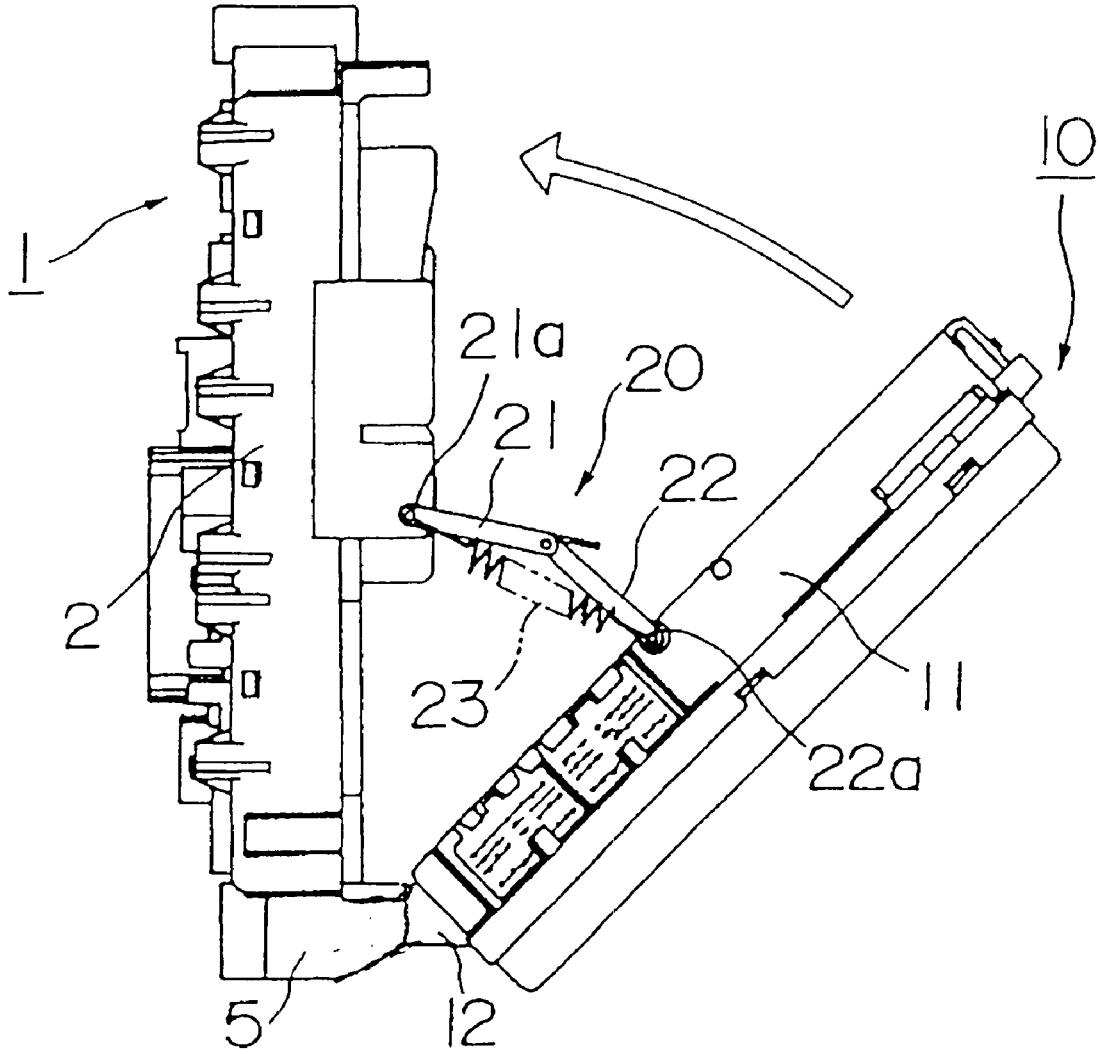
FIG. 4 is a side-elevational view showing a structure of mounting an electronic unit on an electric connection box, forming another embodiment of the invention.

In the above embodiment, a fitting force for connecting male and female terminals together is become large relative to an increase in a number of male and female terminals. The above embodiment can provide the structure with operating with a sufficient small fitting force. To further reduce the fitting force, FIG. 4 shows another embodiment of the invention in which there is provided means for assisting in providing the fitting force.

In this embodiment, an assist mechanism 20 for producing a force to assist in imparting the fitting force is mounted between the body casings 2 and 11 connected together through the hinge connection portions defined respectively by the pivot grooves 6 and the pivot rods 13. With respect to a construction of this mechanism, for example, the two body casings 2 and 11 are pivotally connected together by connection levers 21 and 22 through lever pins 21*a* and 22*a*, and a spring member 23 is connected between the lever pins 21*a* and 22*a*.

In the above construction, when the body casing 11 of the electronic unit 10 is pivotally moved upwardly in the combining operation, the two connection levers 21 and 22 are slightly folded relative to each other from a straight condition into an obtuse-angle condition, so that the spring member 23 acts to attract the body casings 2 and 11 toward each other. Thus, there is imparted a spring force which assists in providing the fitting force required for fitting the male and female terminals together. Therefore all of the female terminals can be smoothly and properly connected to the male terminals, respectively.

As described above, in the structure of mounting the electronic unit on the electric connection box in accordance with the invention, the body casings of the electric connection box and the electronic unit are pivotally connected together by the hinge means releasably engaged with each other in a one-touch manner. Therefore any deflection will not occur in the positioning operation during the combining operation, and therefore all of the male terminals can be positively connected to the female terminals, respectively, thus effectively avoiding a so-called half-fitted condition.

In the structure of mounting the electronic unit on the electric connection box in accordance with the invention, one hinge means is the pivot rod while the other hinge means is the U-shaped pivot hole in which the pivot rod is releasably engageable. Therefore the electric connection box and the electronic unit can be easily combined together and separated from each other, thus providing enhanced usability.

In the structure of mounting the electronic unit on the electric connection box in accordance with the invention, when the electronic unit is combined with the electric connection box, the click engagement projection is engaged in the click engagement recess with a feeling of click. It can be conformed from this that all of the male terminals have been properly fitted in the female terminals. Thus effectively avoiding a half-fitted condition.

In the structure of mounting the electronic unit on the electric connection box in accordance with the invention, the assist mechanism having a spring or the like is connected between the body casings of the electric connection box and the electronic unit. A spring force assists in providing the fitting force when the electronic unit is pivotally moved upwardly to be combined with the electric connection box. The male terminals can be easily and properly connected to the female terminals, respectively.

What is claimed is:

1. A mounting structure comprising:

an electronic unit including a first hinge portion and a unit body provided with one of at least one female terminal and at least one male terminal; and an electric connection box combinable with said electronic unit in a combining direction, said electric connection box including a second hinge portion and a box body provided with the other of said at least one female terminal and said at least one male terminal;

wherein said at least one female terminal is electrically connected with said at least one male terminal, respectively, when said electronic unit is combined with said electric connection box, wherein said electronic unit and said electric connection box are connected together through said first hinge portion and said second hinge portion and are pivotally movable relative to each other in said combining direction, said first hinge portion and said second hinge portion are engageable with and disengageable from each other with a one-touch operation, wherein said one-touch operation is defined by allowing said first hinge portion to be engaged with, or disengaged from, said second hinge portion by relative movement of said electronic unit and said electric connection box only wherein said first hinge portion and said second hinge portion are provided on mounting brackets which protrude and extend from said electronic unit and said electric connection box, respectively, and wherein an assist mechanism for imparting a combination-assisting force in a combination operation is provided between said unit body and said box body.

2. A mounting structure according to claim 1, wherein said first hinge portion is a pivot rod, said second hinge portion is a U-shaped pivot recess formed by partially notched said body hinge portion, said pivot rod and said pivot recess are releasably engageable with each other.

3. A mounting structure according to claim 1, wherein said first hinge portion is a U-shaped pivot recess formed by partially notched said first hinge portion, said second hinge portion is a pivot rod, said pivot rod and said pivot hole are releasably engageable with each other.

4. A mounting structure according to claim 1, wherein a click engagement recess is provided at one of said unit body and said box body, a click projection engageable with said engagement recess is provided at the other of said unit body and said box body.

5. A mounting structure according to claim 4, wherein said click projection is engaged with said engagement recess with an attaching sound indicating the complete fitting of said at least one male terminal in said respective at least one female terminal.

6. A mounting structure comprising:

an electronic unit including a unit body provided with one of at least one female terminals and at least one male terminal; and an electric connection box combinable with said electronic unit in a combining direction, said electric connection body including a box body provided with the other of said at least one female terminal and said at least one male terminal;

wherein said at least one female terminal is electrically connected with said at least one male terminal, respectively, when said electronic unit is combined with said electric connection box, wherein said electronic unit and said electric connection box are provided with a hinge mechanism, said hinge mechanism connect said electronic unit and said electric connection box and enable said electronic unit and said electric connection box to be pivotally movable relative to each other in said combining direction, said hinge mechanism can engage with and disengage from said electronic unit and said electric connection box with one-touch operation, wherein said hinge mechanisms respectively provided on said electronic unit and said electric connection box are provided on mounting brackets which protrude and extend from said electronic unit and said electric connection box, respectively, and wherein an assist mechanism for imparting a combination-assisting force in a combination operation is provided between said unit body and said box body.

7. A mounting structure according to claim 6, wherein said hinge mechanism of said electronic unit is a pivot rod, said hinge mechanism of said electric connection box is a U-shaped pivot recess formed by partially notched said electric connection box, said pivot rod and said pivot recess are releasably engageable with each other.

8. A mounting structure according to claim 6, wherein said hinge mechanism of said electronic unit is a U-shaped pivot recess formed by partially notched said electronic unit, said hinge mechanism of said electric connection is a pivot rod, said pivot rod and said pivot recess are releasably engageable with each other.

9. A mounting structure according to claim 6, wherein a click engagement recess is provided at one of said unit body and said box body, a click projection engageable with said engagement recess is provided at the other of said unit body and said box body.

10. Amounting structure according to claim 9, wherein said click projection is engaged with said engagement recess with an attaching sound indicating the complete fitting of said at least one male terminal in said respective at least one female terminal.

11. A mounting structure comprising:

an electronic unit including a first hinge portion and a unit body provided with one of at least one female terminal and at least one male terminal; and an electric connection box combinable with said electronic unit in a combining direction, said electric connection box including a second hinge portion and a box body provided with the other of said at least one female terminal and said at least one male terminal;

wherein said at least one female terminal is electrically connected with said at least one male terminal, respectively, when said electronic unit is combined with said electric connection box, wherein said electronic unit and said electric connection box are connected together through said first hinge portion and said second hinge portion and are pivotally movable relative to each other in said combining direction, said first hinge portion and said second hinge portion are engageable with and disengageable from each other with a one-touch operation, wherein an assist mechanism for imparting a combination-assisting force in a combination operation is provided between said unit body and said box body.

12. A mounting structure according to claim 11, wherein said first hinge portion is a pivot rod, said second hinge portion is a U-shaped pivot recess formed by partially notched said body hinge portion, said pivot rod and said pivot recess are releasably engageable with each other.

13. A mounting structure according to claim 11, wherein said first hinge portion is a U-shaped pivot recess formed by partially notched said first hinge portion, said second hinge portion is a pivot rod, said pivot rod and said pivot hole are releasably engageable with each other.

14. A mounting structure according to claim 11, wherein a click engagement recess is provided at one of said unit body and said box body, a click projection engageable with said engagement recess is provided at the other of said unit body and said box body.

15. A mounting structure according to claim 14, wherein said click projection is engaged with said engagement recess with an attaching sound indicating the complete fitting of said at least one male terminal in said respective at least one female terminal.

16. A mounting structure comprising:

an electronic unit including a unit body provided with one of at least one female terminals and at least one male terminal; and an electric connection box combinable with said electronic unit in a combining direction, said electric connection body including a box body provided with the other of said at least one female terminal and said at least one male terminal;

wherein said at least one female terminal is electrically connected with said at least one male terminal, respectively, when said electronic unit is combined with said electric connection box, wherein said electronic unit and said electric connection box are provided with a hinge mechanism, said hinge mechanism connect said electronic unit and said electric connection box and enable said electronic unit and said electric connection box to be pivotally movable relative to each other in said combining direction, said hinge mechanism can engage with and disengage from said electronic unit and said electric connection box with one-touch operation, wherein an assist mechanism for imparting a combination-assisting force in a combination operation is provided between said unit body and said box body.

17. A mounting structure according to claim 16, wherein said hinge mechanism of said electronic unit is a pivot rod, said hinge mechanism of said electric connection box is a U-shaped pivot recess formed by partially notched said electric connection box, said pivot rod and said pivot recess are releasably engageable with each other.

18. A mounting structure according to claim 16, wherein said hinge mechanism of said electronic unit is a U-shaped pivot recess formed by partially notched said electronic unit, said hinge mechanism of said electric connection is a pivot rod, said pivot rod and said pivot recess are releasably engageable with each other.

19. A mounting structure according to claim 16, wherein a click engagement recess is provided at one of said unit body and said box body, a click projection engageable with said engagement recess is provided at the other of said unit body and said box body.

20. Amounting structure according to claim 19, wherein said click projection is engaged with said engagement recess with an attaching sound indicating the complete fitting of said at least one male terminal in said respective at least one female terminal.

* * * * *